US006607793B2

(12) United States Patent
Hubbard et al.

(10) Patent No.: US 6,607,793 B2
(45) **Date of Patent: *Aug. 19, 2003**

(54) LARGE WIDTH HEAT-WELDABLE ROOF MEMBRANE

(75) Inventors: Michael J. Hubbard, Holland, OH (US); Raymond J. Weinert, Macedonia, OH (US); John Pomeroy, Greensburg, PA (US)

(73) Assignee: Omnova Solutions Inc., Fairlawn, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,034

(22) Filed: Mar. 26, 1999

(65) Prior Publication Data

US 2002/0102422 A1 Aug. 1, 2002

(51) Int. Cl.[7] ..... F16B 5/07; B32B 3/00; B32B 27/08; D06N 7/04; E04B 5/00

(52) U.S. Cl. ..... 428/33; 428/58; 428/61; 428/141; 428/515; 52/409

(58) Field of Search ..... 428/57, 141, 500, 428/515, 33, 54, 58, 61; 52/749.12, 746.11, 408, 409; 156/71, 308.4

(56) References Cited

U.S. PATENT DOCUMENTS

| | | | | |
|---|---|---|---|---|
| 4,855,172 A | | 8/1989 | Chiu | 428/57 |
| 5,204,148 A | | 4/1993 | Alexander et al. | 428/40 |
| 5,206,068 A | | 4/1993 | Kalkanoglu | 428/143 |
| 5,256,228 A | * | 10/1993 | Davis et al. | 156/157 |
| 5,260,111 A | | 11/1993 | Valaitis et al. | 428/57 |
| 5,306,548 A | | 4/1994 | Zabrocki et al. | 428/215 |
| 5,322,724 A | | 6/1994 | Levens | 428/57 |
| 5,468,550 A | * | 11/1995 | Davis et al. | 428/327 |
| 5,486,387 A | | 1/1996 | Mueller | 428/34.7 |
| 5,523,136 A | | 6/1996 | Fischer et al. | 428/35.2 |
| 5,525,426 A | | 6/1996 | Kulzick et al. | 428/412 |
| 5,545,685 A | | 8/1996 | Davis et al. | 524/490 |
| 5,569,516 A | * | 10/1996 | Paeglis et al. | 428/58 |
| 6,253,528 B1 | * | 7/2001 | Hubbard et al. | 52/746.11 |

* cited by examiner

*Primary Examiner*—Paul Thibodeau
*Assistant Examiner*—Sheeba Ahmed
(74) *Attorney, Agent, or Firm*—Larry R. Meenan; Robert F. Rywalski; David G. Burleson

(57) ABSTRACT

A large width single-ply heat-weldable roof membrane. The roof membrane includes at least two sheets of a thermoplastic polyolefin and one fold strip of a thermoplastic elastomer. The sheets have side edges. The fold strip is bonded to the sheets to join the sheets and form the large width single-ply roof membrane. The thermoplastic elastomer consists of a highly cross-linked rubbery polymer and a thermoplastic polymer.

9 Claims, 1 Drawing Sheet

LARGE WIDTH HEAT-WELDABLE ROOF MEMBRANE

FIELD OF THE INVENTION

This invention relates to a large width heat-weldable roof membrane. More particularly, this invention relates to a large width single-ply heat weldable roof membrane comprising at least two thermoplastic olefin (TPO) membranes joined by an intervening fold strip comprising a thermoplastic elastomer material (TPE).

BACKGROUND OF THE INVENTION

A membrane roofing system generally includes a roof deck which is considered the structural supporting surface of a building extending between the surrounding exterior walls of the building. The roof deck may be constructed from plywood, metal decking or concrete or any other suitable material. Depending upon the construction, the roof deck may extend over the surrounding exterior walls or the roof deck may stop short of the exterior walls thereby forming a parapet wall, i.e., a low retaining wall at the edge of the roof deck. If desired, the membrane roofing system may also include an insulation barrier formed from polyisocyanarate or any other suitable material applied over the roof deck.

To make the roof deck and building weather resistant a single-ply membrane roof may be installed over the roof deck. The single-ply membrane roof refers to a water impermeable single sheet of polymeric material such as thermoplastic olefins, chlorinated polyethylene, polyvinyl chloride, chlorosulfanated polyethylene or ethylene propylene diene rubber (EPDM) having a preapplied hot melt adhesive. The membrane roof has heretofore been installed on the roof deck using a variety of different methods well known in the art.

Because of outstanding weathering resistance and flexibility, cured EPDM based roofing membrane has rapidly gained acceptance.

Typically, the roofing material comes in rolls and is rolled on in strips running the length of the building with a slight overlap between adjacent strips to provide a lap joint. Unfortunately, in the past such roofing material has typically been available only in rolls of relatively narrow width, for example, four feet wide. For a roof of large dimensions, such as 200 feet by 400 feet, the time required to apply the roofing material strips of narrow width becomes excessive and, in light of today's high labor casts, relatively expensive. To reduce the application time, and hence the cost, of roofing, it is desirable to provide as large a width of single-ply roof membrane, such as forty feet or more wide, as possible. The time required to roof a building in this manner is a mere fraction, of that previously necessary with sheet stock of narrower width, e.g., 4 feet wide. However, one problem with most of the thermoplastic materials that can be used for single ply roofing is that they don't return to their original shape when they are folded for shipment. For example, there are problems associated with the creases that are formed when the large width single-ply roof membrane is folded. First, the creases present an application problem for the installers. Second, the creased area provides an area that is stressed and can age faster than the non-folded area of the material.

This invention relates to a method and apparatus for providing indefinite length stock of very large width heat weldable membrane, e.g., TPO membrane, from indefinite length stock of relatively narrower width that may be folded for shipment.

Accordingly, it is an object of this invention to provide a large width heat-weldable roof membrane of indefinite length and a method of manufacture. It is another object of this invention to provide a large width single-ply heat weldable roof membrane of indefinite length comprising at least two thermoplastic olefin membranes joined by an intervening fold strip of thermoplastic elastomer material and a method of manufacturing the same.

SUMMARY OF THE INVENTION

Briefly, the present invention relates to a large width single-ply heat-weldable roof membrane. The roof membrane includes at least two sheets of a thermoplastic polyolefin and one fold strip of a thermoplastic elastomer. The sheets have side edges. The fold strip is bonded to the sheets to join the sheets and form the large width single-ply roof membrane. The thermoplastic elastomer consists of a highly cross-linked rubbery polymer and a thermoplastic polymer.

The rubbery polymer is comprised of ethylene-propylene-diene termonomer and the thermoplastic polymer is comprised of polypropylene. The rubbery polymer may be cross-linked EPDM having a clear surface, ethylene-propylene rubber and polypropylene, ethylene octene and the like. The thermoplastic polymer is comprised of uncrosslinked polyolefins that are thermoplastic. In a preferred embodiment, the thermoplastic polyolefin is a polymer of ethylene, propylene and diene monomers.

In one embodiment, the sheets are positioned adjacent one another such that a side edge of each sheet is contiguous and the fold strip overlaps the contiguous side edges. In another embodiment, the fold strip is positioned between the sheets and bonded to a side edge of the sheets to form a large width single-ply heat-weldable roof membrane.

It will be appreciated that the fold strip facilitates folding of the large width membrane along the fold strip without creating a permanent crease within the membrane.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
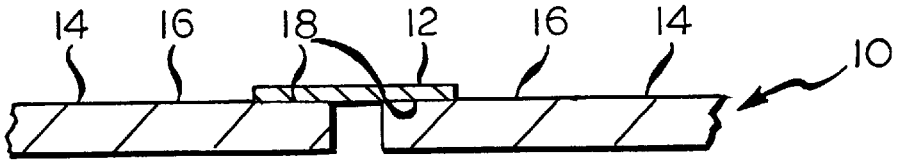
FIG. 1 is a partial perspective view of a single-ply sheet of roofing membrane.

Referring to the figures, wherein like reference characters represent like elements, there is shown a single-ply sheet of roofing membrane 10. As noted, the roofing membrane used in the present invention comprises thermoplastic polyolefins (TPO) and thermoplastic elastomers (TPE).

The term "thermoplastic polyolefin" refers to uncrosslinked polyolefins that are thermoplastic. The thermoplastic polyolefins are made by blending ethylene-propylene polymers with polypropylene. The ethylene-propylene polymers may be blended with polypropylene by conventional mixing techniques. In an alternative embodiment, ethylene-propylene and polypropylene are made in a reactor simultaneously creating a homogenous mixture. The polymer is formulated with stabilizers, pigments and antioxidants to obtain the appropriate adhesive properties.

Preferably, TPO's include ethylene-propylene rubber blended with polypropylene. Suitable TPO's are available from Montell North America, Inc. under the designation Adflex KS-353P and Adflex KS-357P.

Alternatively, the TPO is an EPDM. The term EPDM is intended to mean a polymer of ethylene, propylene and diene monomers with the residual unsaturation portion of the diene in the side chain. Illustrative methods for preparing such terpolymers are found in U.S. Pat. No. 3,280,082, the disclosure of which is incorporated herein by reference. The preferred polymers having from about 60 to about 95 weight percent ethylene and from about zero to about 12 weight percent of the diene with the balance of the polymer being propylene or some other similar olefin type monomer.

The diene monomer utilized in forming the EPDM terpolymer is preferably a non-conjugated diene. Illustrative examples of non-conjugated dienes which may be employed are dicyclopentadiene, alkyldicyclopentadiene, 1,4-pentadiene, 1,5-hexadiene, 1,4-heptadiene, 2-methyl-1,5-hexadiene, cyclooctadiene, 1,4-octadiene, 1,6-octadiene, 5-ethylidene-2-norborene, 5-n-propylidene-2-norbornene, 5-(2-methyl-2-butenyl)-2-norboenene and the like. A typical EPDM is Vistalon ® MD-744 (Exxon Chemical Co.) a terpolymer having a Mooney Viscosity (ML/4 at 125 C.) of about 52; an ethylene/propylene (E/P) ratio of 61/39 weight percent and 2.7 weight percent of unsaturation. (5-ethylidene-2-norbornene). Particularly useful and preferred in preparing a sulfur curable EPDM composition is Royalene ® 3180 (Uniroyal Chemical Co.) which has a Mooney Viscosity (ML/4 at 125° C.) of about 54; an ethylene/propylene ratio of about 67/33 weight percent; about 2.2 weight percent of unsaturation; about 2.7 percent by weight of crystallinity and a weight average molecular weight of approximately 313,000 to 355,000. Also useful are thermoplastic heat seamable sheeting materials, i.e., EPDM's having a high degree of crystallinity as opposed to amorphous (non-crystalline) EPDM's. Examples thereof include Royalene ® 375 (Uniroyal Chemical Co.); and EPsyn ® 5508.

The composition employed to form the sheeting material comprises 100 parts by weight of EPDM or other similar olefinic type polymers, including mixtures of two or more types, to which are added fillers and processing materials as well as optionally other components including curatives as well known in the art.

The compounding ingredients can be admixed, utilizing an internal mixer (such as a Banbury mixer), an extruder, and/or a two-roll mill, or other mixers suitable for forming a viscous relatively uniform admixture. When utilizing a Banbury internal mixer, in a preferred mode, the dry or powdery materials such as carbon black are added first followed by the liquid process oil and finally the polymer (this type of mixing can be referred to as an upside-down mixing technique).

The resulting admixture is sheeted to a thickness ranging from 5 to 200 mils, preferably from 35 to 60 mils, by conventional sheeting methods, for example, milling, calendaring or extrusion. Preferably, the admixture is sheeted to at least 40 gauge (0.040 inches) which is the minimum thickness specified in standards set by the Roofing Council of the Rubber Manufacturers Association for non-reinforced black EPDM rubber sheets for use in roofing applications. In many cases, the admixture is sheeted to 40–45 gauge thickness since this is the thickness for a large percentage of "single-ply" roofing membranes used commercially. The sheeting can be cut to desired length and width dimensions at this time.

Joining the two sheets of TPO is a fold strip of thermoplastic elastomer (TPE). The term "thermoplastic elastomer" refers to an elastomer which can be melt-processed (as contrasted with conventional cross-linked rubbers). The TPE consists of a highly cross-linked rubbery polymer in combination with a thermoplastic polymer. The highly cross-linked rubbery phase may be a polymer comprised of ethylene-propylene-diene termonomer and the thermoplastic polymer may be a polyolefin such as polypropylene.

TPE's are categorized as block copolymers or rubber-plastic polymer blends. Rubber plastic blends are a blend of an elastomer and a semi-crystalline plastic. A compatibilizer may or may not be used to improve properties. The TPE materials are differentiated by their processing and properties when compounded with thermoset rubbers and semcrystalline polymers. Once cured, the thermoset rubbers are not reprocessible in the melt but elastomeric. The semi crystalline polymers do not have the typical elastomeric property extensibility greater than 100% elongation with reversibility (rebounding) to almost its initial length (low hysteresis), but are reprocessible in the melt. A TPE can do both, re-melt processability and 100% elongation with low hysteresis.

As shown in FIG. 1, a thin fold strip 12 of TPE is bonded to a top surface of two adjacent sheets 14 of TPO to form a large width single-ply roofing membrane 10. Each sheet 14 includes a field 16 and parallel marginal edges 18. The fold strip 12 overlaps the edges 18 of the sheets 14 and is bonded to the sheets under elevated temperature and pressure. Generally, the width of the fold strip ranges between about 4–6 inches and has a thickness ranging between about 2–20 mils although greater or less thicknesses may be employed and thus, are not precluded.

Figure 2:
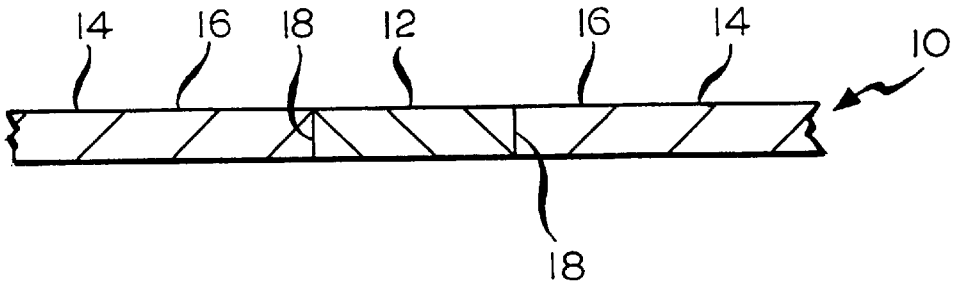
FIG. 2 is a partial perspective view of an alternate embodiment of a single-ply sheet of roofing membrane.

In an alternate embodiment, referring to FIG. 2, the fold strip 12 of TPE is shown flush with the top and bottom field surfaces 16 of two closest sheets 14 of TPO. The fold strip 12 of TPE is extruded between the two finished sheets 14 of TPO or crosshead extruded between two sheets of TPO employing techniques of a type well known in the art. It will be appreciated that an advantage of an extruded fold strip 12 of TPE is that there are no splice joint to present an uneven surface after application to a roof deck. In addition a fold strip of TPE is cured and has the ability to recover or rebound back from the fold created during shipment of the large width membrane.

Figure 3:
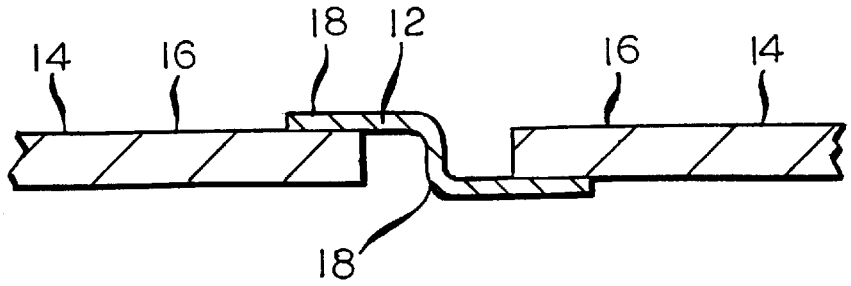
FIG. 3 is partial perspective view of another alternate embodiment of a single-ply sheet of roofing membrane.

In yet another embodiment, as shown in FIG. 3, a first edge of a fold strip 12 of TPE is shown attached to the top surface of sheet 14 and a second edge of the fold strip is shown attached to the bottom surface of an adjacent sheet 14.

A large width roof membrane of TPO including at least one fold strip 12 of TPE facilitates folding of the roofing membrane 10 without adverse consequences previously experienced by roof membranes formed entirely of thermoplastic materials such as TPO.

In a typical manufacture process, the large width heat weldable roof membranes are formed as described above and then folded along the fold strip 12 to provide a compact package for shipment. The width of the roof membrane can vary depending on the requirements specified by the architect, building contractor or roofing contractor and thus, does not constitute a limitation of the present invention.

The patents and documents described herein are hereby incorporated by reference.

Having described presently preferred embodiments of the invention, the invention may be otherwise embodied within the scope of the appended claims.

What is claimed is:

1. A large width single-ply heat-weldable roof membrane comprising:

at least two sheets of a thermoplastic polyolefin, said sheets having side edges; and one fold strip of a thermoplastic elastomer bonded to said sheets to join said sheets; wherein said thermoplastic elastomer is a cross-linked rubbery polymer and a thermoplastic polymer, wherein the rubbery polymer is selected from the group consisting of ethylene-propylene-diene polymer, ethylene-propylene copolymer rubber (EPR), and ethylene octane.

2. The roof membrane of claim 1 wherein the thermoplastic polymer is a polyolefin.

3. The roof membrane of claim 1 wherein the thermoplastic polymer is polypropylene.

4. The roof membrane of claim 1 wherein the thermoplastic polymer is an uncrosslinked polyolefin that is thermoplastic.

5. The roof membrane of claim 1 wherein the thermoplastic polymer is a polymer of ethylene, propylene and diene monomers.

6. The roof membrane of claim 1 wherein the thermoplastic polyolefin is a blend of ethylene-propylene polymer and polypropylene.

7. The roof membrane of claim 1 wherein the thermoplastic polyolefin has from about 60 to about 95 weight percent ethylene and from about 0 to about 12 weight percent of the diene with the balance of the polymer being propylene.

8. The roof membrane of claim 1 wherein the sheets are positioned adjacent one another such that a side edge of each sheet is contiguous wherein the fold strip overlaps the contiguous side edges.

9. The roof membrane of claim 1 wherein the fold strip is positioned between the sheets and bonded to a side edge of the sheets to form a large width single-ply heat-weldable roof membrane.

* * * * *